United States Patent [19]

Dalrymple et al.

[11] 4,291,841

[45] Sep. 29, 1981

[54] METHODS OF AND APPARATUS FOR TAKING UP LIGHTGUIDE FIBER

[75] Inventors: Philip W. Dalrymple; Michael J. Hyle, both of Doraville; Daryl L. Myers, Lawrenceville; James G. Wright, Jr., Roswell, all of Ga.

[73] Assignee: Western Electric Company, Inc., New York, N.Y.

[21] Appl. No.: 135,808

[22] Filed: Mar. 31, 1980

[51] Int. Cl.[3] ..... B65H 54/02; B65H 67/04

[52] U.S. Cl. ..... 242/18 A; 242/25 A

[58] Field of Search ..... 242/18 A, 25 A, 56 R, 242/56 A, 19

[56] References Cited

U.S. PATENT DOCUMENTS

| | | | |
|---|---|---|---|
| 2,622,810 | 12/1952 | Stream et al. | 242/18 A |
| 2,663,507 | 12/1953 | Soussloff | 242/18 A |
| 2,893,652 | 7/1959 | Davis | 242/25 A |
| 3,368,765 | 2/1968 | O'Grady | 242/25 A |
| 3,596,844 | 8/1971 | Engmann | 242/25 A |
| 3,823,885 | 7/1974 | De Schulthess | 242/18 A |
| 3,936,006 | 2/1976 | List et al. | 242/18 A |
| 4,138,069 | 2/1979 | Bonzo et al. | 242/18 A |
| 4,184,653 | 1/1980 | Bonzo | 242/18 A X |

*Primary Examiner*—Stanley N. Gilreath
*Attorney, Agent, or Firm*—E. W. Somers

[57] ABSTRACT

In taking up drawn lightguide fiber (31), the fiber is distributed on the hub of one of two coaxially mounted takeup spools 42–42 which are driven independently of each other at ends of indexable turrets (94–94) that also have spools mounted on their opposite ends. Following takeup on one of the spools, a distributor 201 effects a cutover to a collector groove of the adjacent spool until several convolutions of the fiber are secured within the collector groove to provide access to a leading end of the fiber on this spool for testing purposes. Then the distributor begins its traverse across the hub of the empty spool and the lightguide fiber which extends across the adjacent collector spools is severed to form an end portion on the spool now being filled, said end portion advantageously being accessible for testing. The full spool is caused to be moved out of its takeup position and another empty spool is moved into that position to be filled after takeup has been completed on the spool in the other takeup position.

23 Claims, 15 Drawing Figures

Fig. 6
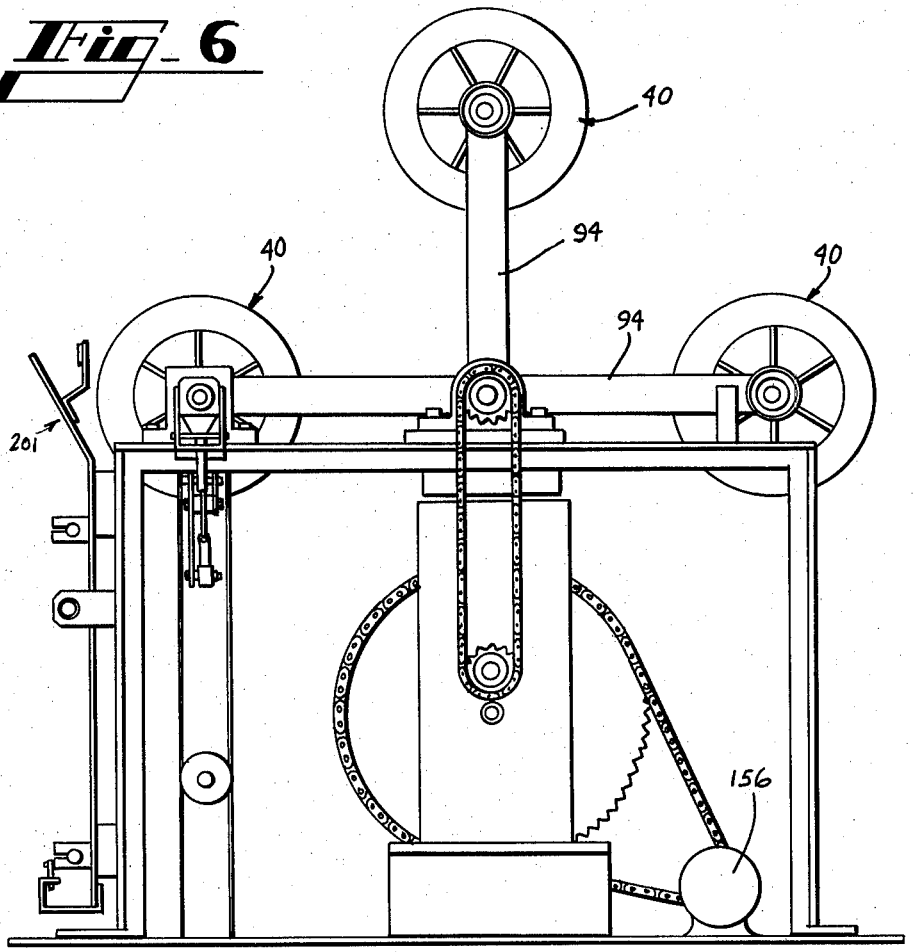
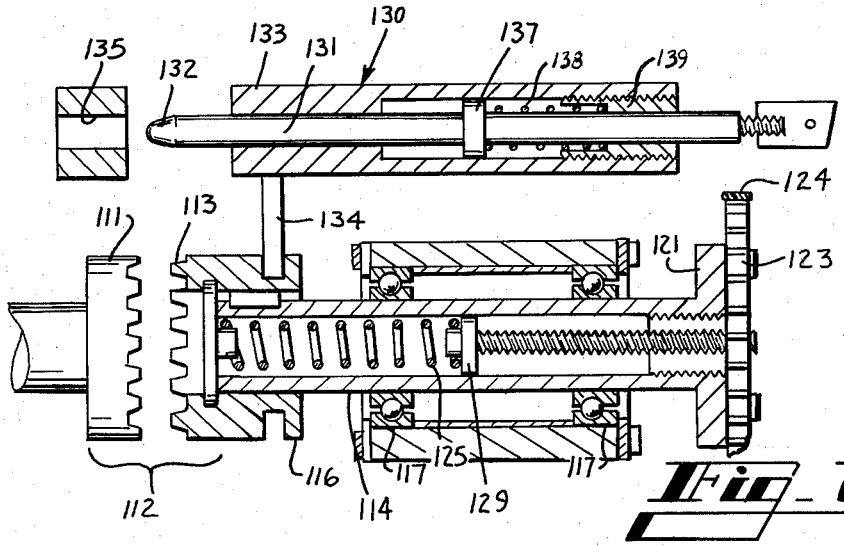
Fig. 7

METHODS OF AND APPARATUS FOR TAKING UP LIGHTGUIDE FIBER

TECHNICAL FIELD

This invention relates to methods of and apparatus for taking up drawn fiber lightguides and, more particularly, to the uninterrupted take up of lightguide fiber which is drawn from a vertically suspended preform.

BACKGROUND OF THE INVENTION

Not since microwave radio has there been as significant a technology developed in telecommunications as lightwave technology which is manifested in the use of fiber lightguides. Optical or lightguide fibers are inherently versatile as a transmission medium, all forms of information be it voice, video or data can be carried on a fiber lightguide. Also, lightwave systems are ideally suited to the high bandwidth requirement of digital transmission and hence are well-matched to the evolving transmission network in this country.

The medium for lightwave transmission is glass, a solid whose structure is amorphous or random, as opposed to the crystalline structure that normally results when molten materials solidify. Fibers for lightwave communications are drawn from a preform—an elongated cylinder of glass having an inner core and an outer cladding—with the thickness of the core and the cladding being in the same ratio in the fiber as they are in the preform. A drawing system is well-described in an article by D. H. Smithgall and D. L. Myers in the winter 1980 issue of the *Western Electric Engineer.*

In the drawing system, the preform is fed into a heated region where it necks down to the fiber size as the fiber is pulled from the heat zone. The diameter is measured at a point shortly after the fiber is formed, and this measured value is input to a control system. Within the controller, the measured fiber diameter is compared to a desired value and an output signal is generated to adjust the draw speed such that the fiber diameter approaches the desired value. After the fiber diameter is measured, a protective coating is applied and the material is cured on the fiber.

The drawn fiber is taken up on a lightweight, plastic spool such that end portions of the fiber on each spool are available for testing. The spools of drawn, tested fiber are subsequently used to supply ribbon and/or cabling apparatus.

The winding parameters during takeup must be carefully controlled; collection at low tension is necessary in order to minimize the damage to the fiber or a coating thereon and reduce the effect of microbending loss on transmission measurement. Therefore, the winding tension is minimized and the distribution of fiber across a spool is controlled to facilitate unwinding at a subsequent operation.

The control fiber tension, the fiber is allowed to form a catenary between the capstan and the take-up. As the spool fills, the catenary tends to decrease in length and it becomes necessary to decrease take-up motor speed under controlled conditions. This is accomplished with an electro-optical system including a closed circuit television camera which detects any change in the height of the fiber catenary and causes changes in the take-up motor speed. This arrangement is described in commonly assigned application Ser. No. 040,026 filed on May 18, 1979 in the name of R. E. Frazee, Jr.

In addition to the problem of correlating the rotation of the takeup spool, a problem has been the uninterrupted takeup of all the fiber that can be drawn from a preform. Since the spools currently in use will each hold only a fraction of the total product output of a single preform, an operator must manually make a cutover between spools supported on a common axis, which introduces additional handling and possibly delay time in the takeup.

Widespread use of lightguide fiber cables will require that economies must be introduced into present manufacturing processes. It would be desirable, for example, that the drawing of a preform and its takeup be accomplished so that all the fiber drawn from a single preform is taken up without interruption and with a minimum of handling.

Further, the manufacture of lightguide fiber requires the use of sophisticated testing procedures at each step in order to insure a lightguide fiber of the highest quality. In order to accomplish this at takeup, it is necessary that the end of the lightguide fiber which initially engages a spool, as well as the final end portion on a spool, be accessible so that test apparatus can be connected thereto to facilitate testing during takeup.

While the prior art is replete with patents that disclose takeups particularly for copper based conductors, there is no known takeup which is ideally suited for taking up lightguide fiber. Such a system must include provisions for accessing an inner end of the lightguide package and must provide for continuous uninterrupted takeup while being capable of being controlled to avoid undue stressing of the lightguide fiber as it is taken up.

In the prior art, Bonzo et al in U.S. Pat. No. 4,138,069 shows a tangential cutover type of takeup apparatus for glass optical filaments in which a plurality of spools are mounted rotatably on parallel axes projecting from a turret so that as one spool is wound full, it is moved out of a takeup position, the filament is attached to an empty spool which is moved into the takeup position, and the filament is severed from the full spool. Each of the spools is constructed with one flange having a rubber extension which includes two humps with a rubber O-ring disposed between the humps. Since a roller is used to depress a hump away from the O-ring to form a gap into which the filament falls and is gripped when the roller is disengaged, the timing during cutover is critical in order to form the gap and input the filament. The prior art also includes U.S. Pat. No. 2,893,652 which shows a common axis takeup arrangement in which a flange of a reel includes a generally V-shaped groove and one or more angularly spaced detents on the flange to catch wound stock if some should escape from the groove and tend to unwind. In another common axis arrangement, a spool flange is provided with a groove in the flange which extends across a chord of the flange tangent to the spool hub and into which groove a length of wire extending from a snagger at cutover is forced. Because of the impact that a snagger has on an elongated material being taken up at cutover, the use of a snagger to capture drawn lightguide fiber is not preferred.

What is needed is a drawn lightguide fiber takeup apparatus which is specially suited to the handling of this kind of material without abuse, which is uncomplicated and which provides a takeup package in which the leading end of the fiber on a spool is accessible for testing. The length of the accessible leading end must not be so long that it whips about the spool during takeup causing damage to the other convolutions.

SUMMARY OF THE INVENTION

The foregoing needs of a lightguide fiber takeup are provided by the methods and apparatus of this invention. A method of taking up lightguide fiber includes the steps of supporting each of a first and second plurality of spools for rotation about an axis with the axes of rotation of the spools of each plurality being parallel, and mounting each plurality of spools for revolution about an axis which is parallel to the axes of the spools of said plurality, said axes of rotation of said spools of each plurality being spaced equal distances from the axis of revolution of said each plurality. One of the spools of said first plurality in a first takeup position is held in coaxial alignment with one of said spools of said second plurality in a second takeup position, and the spools in the takeup positions are caused to be rotated. A length of the lightguide fiber adjacent one flange of the one spool of said first plurality in said first takeup position is taken up, after which a predetermined length of the fiber is distributed in a plurality of convolutions across the spool in the first takeup position. Then a length of the fiber is taken up adjacent to one flange of the spool in the second takeup position, said one flange of the spool in the second takeup position being adjacent the one flange of the spool in the first takeup position and a predetermined length of the fiber is distributed across the spool in the second takeup position. The lightguide fiber which extends between the spools in the takeup positions is severed and the first plurality of spools is revolved to move the one spool on which has been distributed said predetermined length of fiber in a plurality of convolutions out of the first takeup position. The distribution traverse is controlled about a reference point to decrement the length of travel of a distributor on each side of the reference point to shape the package of lightguide fiber in a predetermined manner.

An apparatus for taking up lightguide fiber which is drawn from a preform includes facilities for supporting each of a first and a second plurality of spools for rotation about an axis with the axes of rotation of said spools of each plurality being parallel, facilities for mounting each plurality of spools for revolution about an axis which is parallel to the axes of rotation of the spools of each plurality, with said axis of rotation of each of said spools being an equal distance from the axes of revolution, and facilities for holding one of said spools of said first plurality in a first takeup position in coaxial alignment with one of said spools of said second plurality of spools in a second takeup position. Means are rendered effective by a spool being in one of the takeup positions for rotating said spool in said takeup position and means are mounted for reciprocal movment along a path of travel which is parallel to and spaced from the colinear axes of rotation of the spools in the first and the second takeup positions for distributing lightguide fiber on one of the spools in one of said takeup positions. A relatively short length of lightguide fiber is caused to be taken up on a collector spool which is attached to one of the spools in one of the takeup positions adjacent a centerline of the apparatus and then a plurality of convolutions of lightguide fiber are distributed on the spool in the one position. In response to the takeup of a predetermined length of fiber on the spool in the one position, a relatively short length of lightguide fiber is taken up on a collector spool which is connected to the spool in the other takeup position and subsequently, a plurality of convolutions of fiber are distributed on the spool in the other position, said collector spools being adjacent each other. The fiber which has been taken up on the spool in the one takeup position is separated from the relatively short length on the spool in the other takeup position to provide an accessible beginning end portion on the other spool, and facilities are responsive to the separation of the fiber for revolving said first plurality of spools to move the full spool out of the one takeup position.

BRIEF DESCRIPTION OF THE DRAWINGS

Other features of the present invention will be more readily understood from the following detailed description of specific embodiments thereof when read in conjunction with the accompanying drawings, in which:

FIG. 6 is an alternate embodiment of a takeup apparatus in which each turret is arranged to include a plurality of spool assemblies;

FIG. 7 is a detail view of a clutch used in FIG. 1;

DETAILED DESCRIPTION

Figure 1:
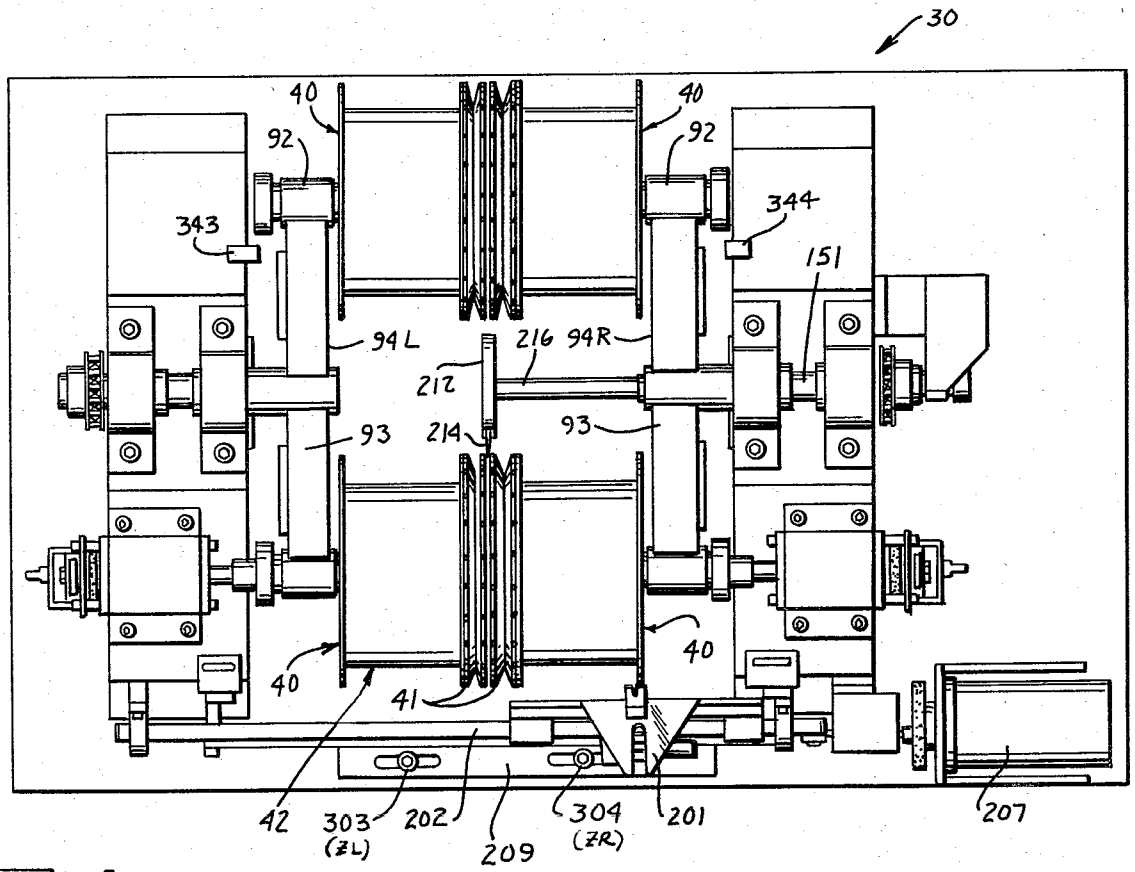
FIG. 1 is an overall plan view of an apparatus of this invention for taking up lightguide fiber and showing four spool assemblies with two of the spool assemblies being aligned coaxially in two adjacent takeup positions.
Figure 2:
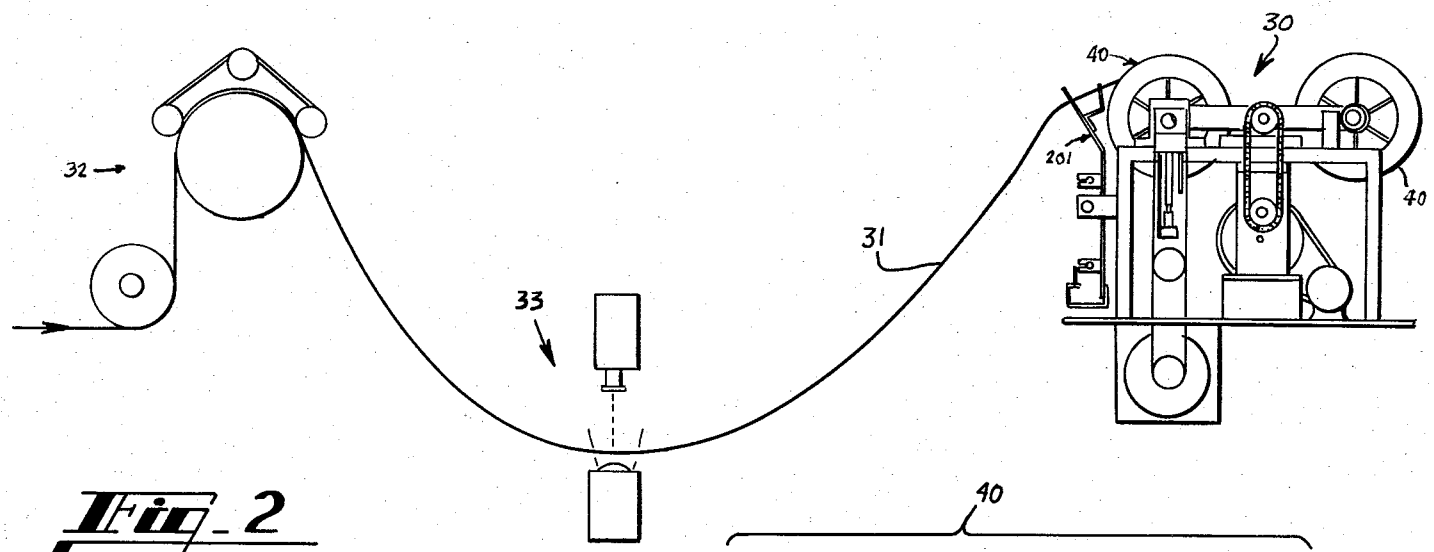
FIG. 2 is an elevational view of the takeup apparatus of FIG. 1 used in cooperation with a fiber draw and catenary control system.

Referring now to FIGS. 1 and 2, there is shown an apparatus designated generally by the numeral 30, for taking up drawn lightguide 31. The apparatus 30 is designed to support independently each of two groups of spool assemblies 40—40 on each of which may be taken up a plurality of convolutions of the drawn lightguide fiber 31. In a preferred embodiment of this invention which is shown in FIG. 1, the apparatus 30 supports four spool assemblies 40—40 with two spools comprising each group. Desirably, the four spools 40—40 are sufficient to take up all the fiber which is drawn from one preform in a drawing apparatus 32 described in the hereinbefore-identified issue of the *Western Electric Engineer* and through a catenary control system 33 which is described in the hereinbefore identified application Ser. No. 040,026.

Figure 3:
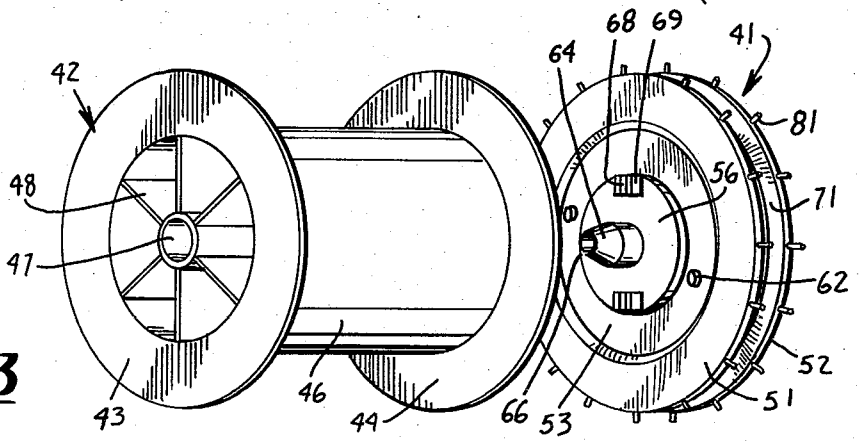
FIG. 3 is an exploded perspective view of one of the spool assemblies which comprises a takeup spool and a collector spool.

Going now to FIG. 3, it is seen that each of the spool assemblies 40—40 includes a collector spool 41 and a takeup spool 42. The takeup spool 42 is made of a plastic material such as ABS and includes a pair of spaced flanges 43 and 44 which are connected together through a hub 46. The takeup spool 42 also includes a centrally disposed tube 47 which is connected to an inwardly facing surface of the hub 46 through a plurality of angularly spaced, radially extending ribs 48—48. In a preferred embodiment, the hub 46 and the flanges 43 and 44 are designed so that the spool 42 can accommodate at least 2500 meters of drawn lightguide fiber 31.

In order to facilitate cutover between full and empty spools, and to provide access to the initial end portion of fiber 31 on a takeup spool 42 the spool assembly 40 includes the collector spool 41 which comprises a pair of circular side plates 51 and 52 which are made of a plastic material. The side plates 51 and 52 each have an outwardly facing dished-out portion 53 and 54, (see also FIG. 4) respectively which are held together between a circular driving plate 56 and a stepped circular portion 57 which is fastened to plate 51 by fasteners 62—62.

The plate 56 is metallic and is designed to transfer rotary motion from other elements of the apparatus 30 to the takeup spool 42. This is accomplished by constructing the metallic plate 56 with a truncated cone 64 extending through the plate with a keyway 66 being formed therethrough from an outwardly facing surface of the small diameter portion of the plate to the free end tip of the cone. This facilitates the mounting of the collector spool 41 on a driving spindle in a way to transmit motion from the spindle to the spool assembly 40.

The spool assembly 40 is made by inserting the truncated cone portion 64 into one end of the center tube 47 so that two diametrically opposed channels 68—68 formed between pairs of upstanding ways 69—69 receive portions of ones of the ribs 48—48. In the way, the motion of the collector spool 41 is transmitted through the ways 69—69 to the ribs 48—48 and hence to the takeup spool 43.

Figure 4A:
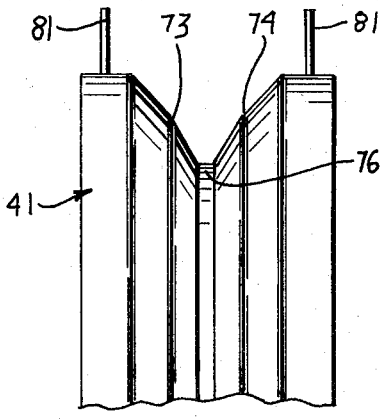
FIGS. 4A and 4B are detail views of portions of the flanges of alternative embodiments of the collector spool.
Figure 4B:
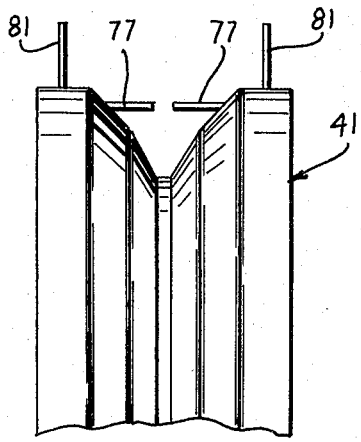

The spool assembly 40 also includes provisions for effecting cutover of the lightguide fiber from a full spool to an empty one. This is accomplished by constructing the side plates 51 and 52 of the collector spool 42 to form a collector or sample groove 71 therebetween. This groove 71 can be generally V-shaped and is used to collect an initial few convolutions of the lightguide fiber 31 which are associated with each takeup spool at cutover time prior to the actual takeup on the hub 46 of the associated takeup spool 42. However, in a preferred embodiment shown in FIG. 4A, the peripheral portions of the plate 51 and 52 are formed to provide a two stage groove 73. This groove 73 includes a steeply tapered lead in portion 74 and a gently tapered inner portion 76 which has a groove width that is substantially equal to the diameter of the lightguide fiber. In an alternative embodiment as shown in FIG. 4C, a plurality of relatively flexible whiskers 77—77 of a plastic material are inserted through apertures formed through the plates 51 and 52. Then the whiskers 77—77 are cut generally midway between the plates 51 and 52 so that the lightguide fiber 31 is able to enter the groove and be confined therein by the split whiskers.

The provisions for cutover also include a plurality of relatively flexible whiskers 81—81 which extend radially outward from peripheral edge surfaces 82 and 83 of the plastic side plates 51 and 52, respectively. The whiskers 81—81 are made of a plastic material and are designed to engage the lightguide fiber 31 without abusing it and to cause it first to enter the collector groove and, secondly, to engage the hub 46 of the takeup spool 42.

Figure 5:
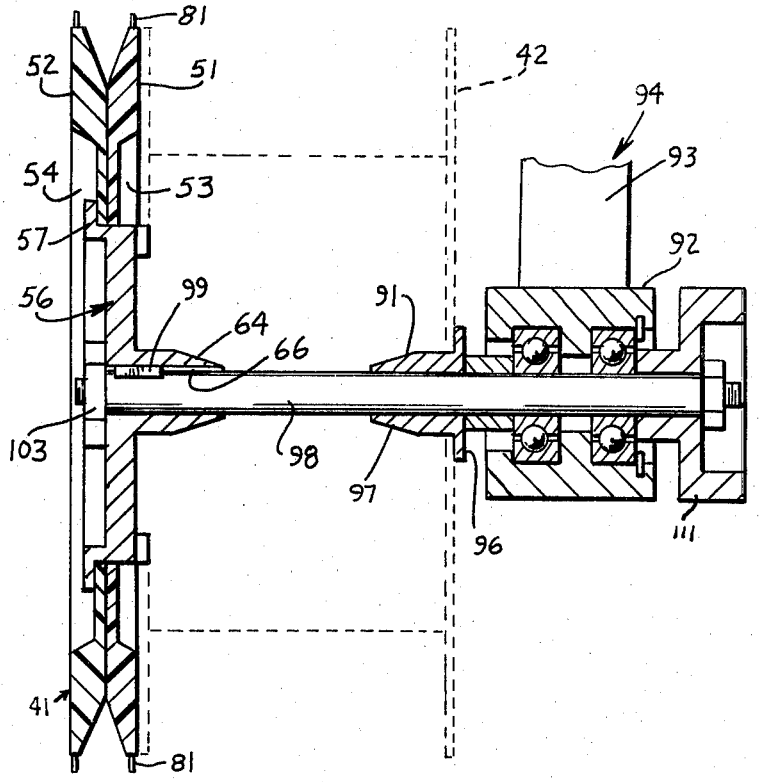
FIG. 5 is a detail view of a portion of the apparatus of FIG. 1 for supporting a spool assembly.
Figure 9:
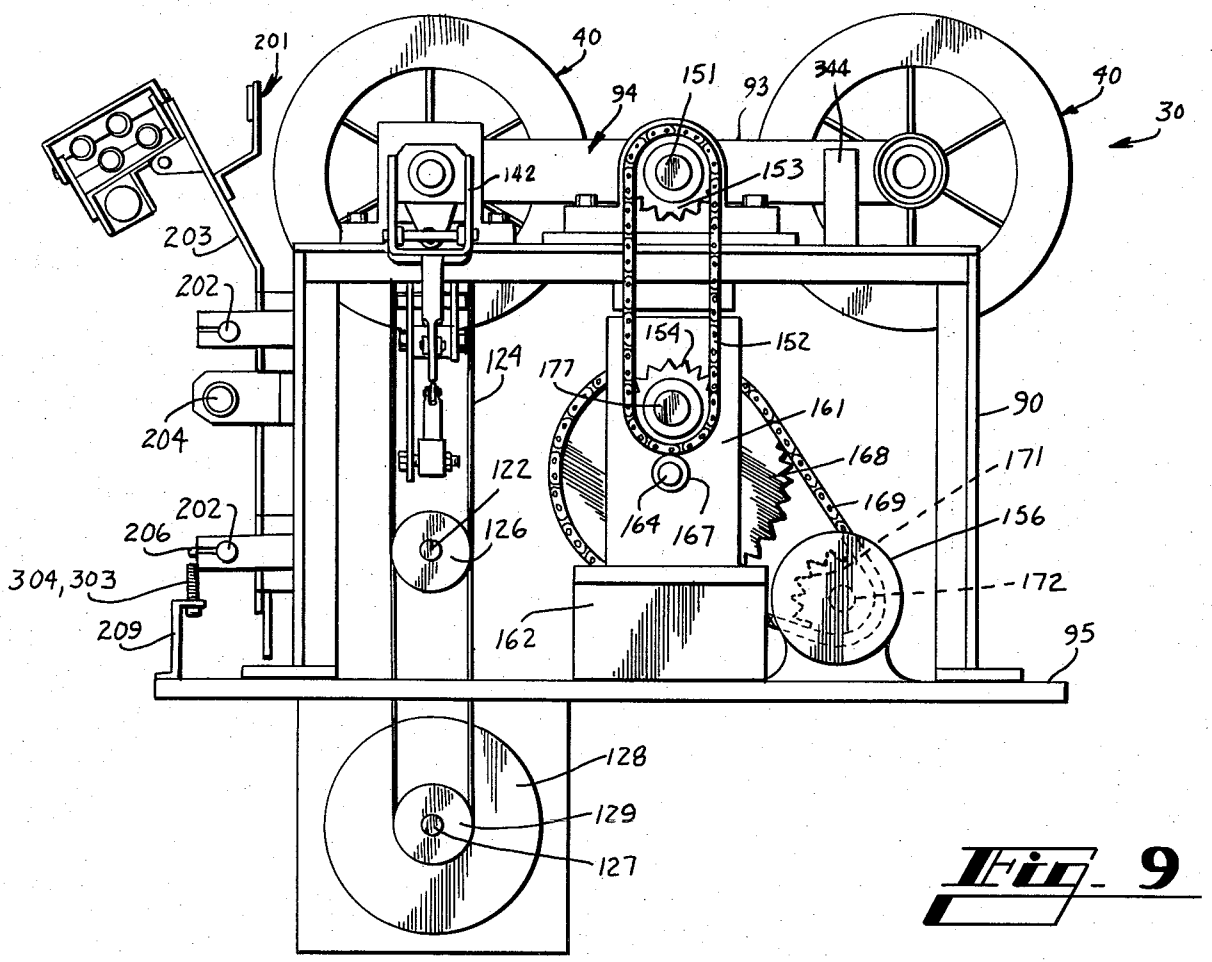
FIG. 9 is a side elevational view of a portion of the apparatus in FIG. 1 showing a turret arm with a spool assembly mounted at each end thereof.
Figure 11:
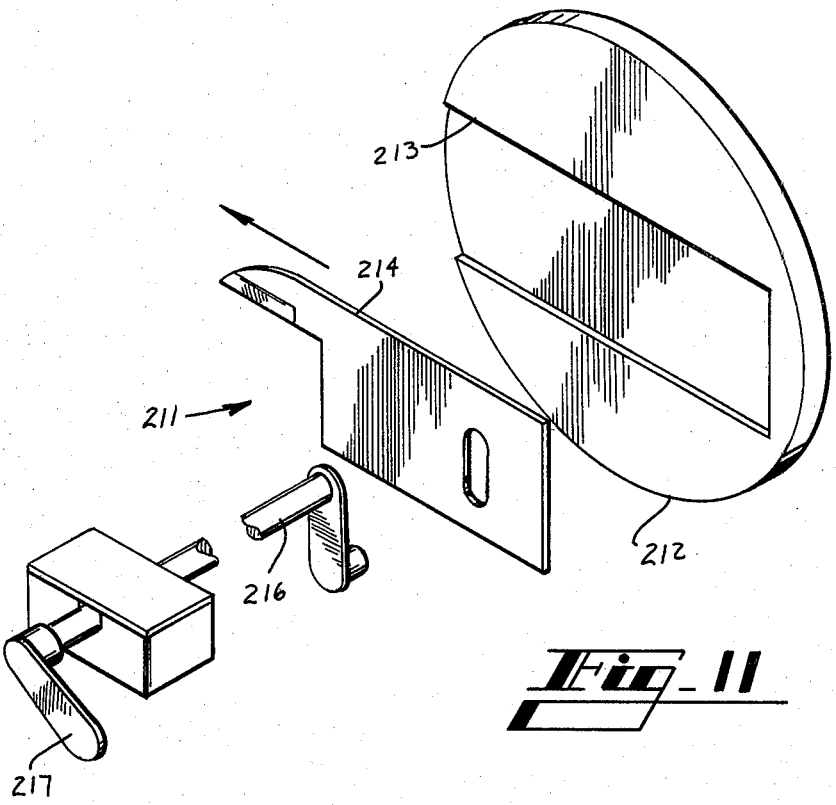
FIG. 11 is an enlarged perspective view of a device used to cut the lightguide fiber at transfer between spools.

Turning now to FIG. 5, it can be seen that each of the spool assemblies 40—40 is mounted for rotation on an arbor designated generally by the numeral 91 that extends from a hub 92 at one end of an arm 93 of a turret 94 that is mounted in a frame 90 see also FIG. 9 which is supported from a base 95. The arbor 91 includes an end flange 96 with a tapered portion 97 connected to a spindle 98 having a key 99 projecting radially adjacent a free end thereof. The free end of the spindle 98 has externally threaded portion 101 for receiving a locking nut 103. In preparing the apparatus 30 for takeup of lightguide fiber 31 from a preform (not shown), an operator turns off the locking nut 103 and moves a spool assembly 40 onto the spindle 98. The spool assembly 40 is oriented with its collector spool 41 being adjacent the threaded portion 101, so that the key 99 is received in the guideway 66 and so that the truncated cone portion 97 of the arbor 91 enters the tube 47 of the hub 46 of the takeup spool 42. Then the operator turns the locking nut 103 onto the threaded portion 101 to engages an outer surface of the small diameter portion of the plate 57 of the spool assemlby 40. This sequence of steps is repeated until one of the spool assemblies 40—40 is loaded onto the arbor 91 at each end of each turret 94.

It should be understood that while the preferred embodiment includes two turrets 94—94 each of which supports rotatably two spool assemblies 40—40, that the invention is not so limited. Each turret 94 could be constructed to support a greater number of spool assemblies 40—40 (see FIG. 7) which could be useful in the event that a larger preform were made and used in the draw operation.

Turning now to a description of facilities for rotating the spool assemblies 40—40, it can be seen from FIG. 7 that each spindle 98 extends through its associated hub 92 and has a female portion 111 of a tooth type clutch 112 attached thereto. When each spool assembly 40 is in one of the takeup positions, it is caused to be driven by a male portion 113 of the clutch 112. The male portion 113 of the clutch 112 is keyed to a shaft 114 which extends through a collar portion 116 of the clutch and then through bearings 117—117 in a support 118 that is mounted on a frame. An outer end 121 of the shaft 114 in each of the takeup positions is keyed to a sprocket 123. In order to drive the shaft 114 and hence the arbor 91 through the clutch 112, a belt 124 (see also FIG. 9) is passed around the sprocket 123 and then downwardly to a sprocket 126 that is mounted on a jack shaft 122 which drives the spindles 98—98 in both takeup positions. A shaft 127 of a drive motor 128 extends horizontally and has another sprocket 129 mounted thereon with another belt being passed therearound for driving the jack shaft 122. The clutch shaft 114 has a spring 125 disposed internally for normally biasing the male clutch plate 113 toward a female clutch plate 11. As can be seen in FIG. 9, the spring 125 bears against a stop 129 that is adjustable by a threaded rod.

The male portion 113 of the clutch 112 is caused to engage and to disengage the female portion 111 by an actuator which is designated generally by the numeral 130. Referring again to FIG. 7, it can be seen that the device includes a rod 131 having a pin end 132 that is mounted for sliding movement through an opening 135 in a plate that is attached to the turret 94. The rod 131 extends rearwardly away from the spool assembly position, and through a bushing 133 having a forked, plate-like portion 134 extending laterally therefrom and between the male portion 113 and the collar 116 of the clutch assembly. From there, the rod 131 extends through an internally bore of the bushing 133. The rod 131 is formed to have shoulder portions 137—137 extending therefrom within bore in the bushing 133 with a compression spring 138 disposed concentrically about the rod between the shoulder portions and the inner face 139 of an externally threaded plug 139. The compression spring 138 is selected so that its spring constant is substantially greater than that of the spring 125 which is disposed about the clutch 115.

The rod 131 extends through the bushing 133 and the plug 139 and is pin connected to a pivotally mounted lever 141 (see FIG. 8) through a clevice portion 142. A lower end 143 of the lever 141 is pin connected to a piston rod 144 of an air cylinder 146. The operation of the air cylinder 146 to withdraw the piston rod 144 causes the rod 131 to be moved to the right as viewed in FIG. 5 to withdraw the pin end 132 from the turret arm and compressing the spring 138 between the shoulder portions 137—137 and the plug 139. The movement of the rod 131 causes the forked member 134 to cause the male clutch 113 to be disengaged from the female plate 111 which interrupts the rotation of spindle 98.

Figure 8:
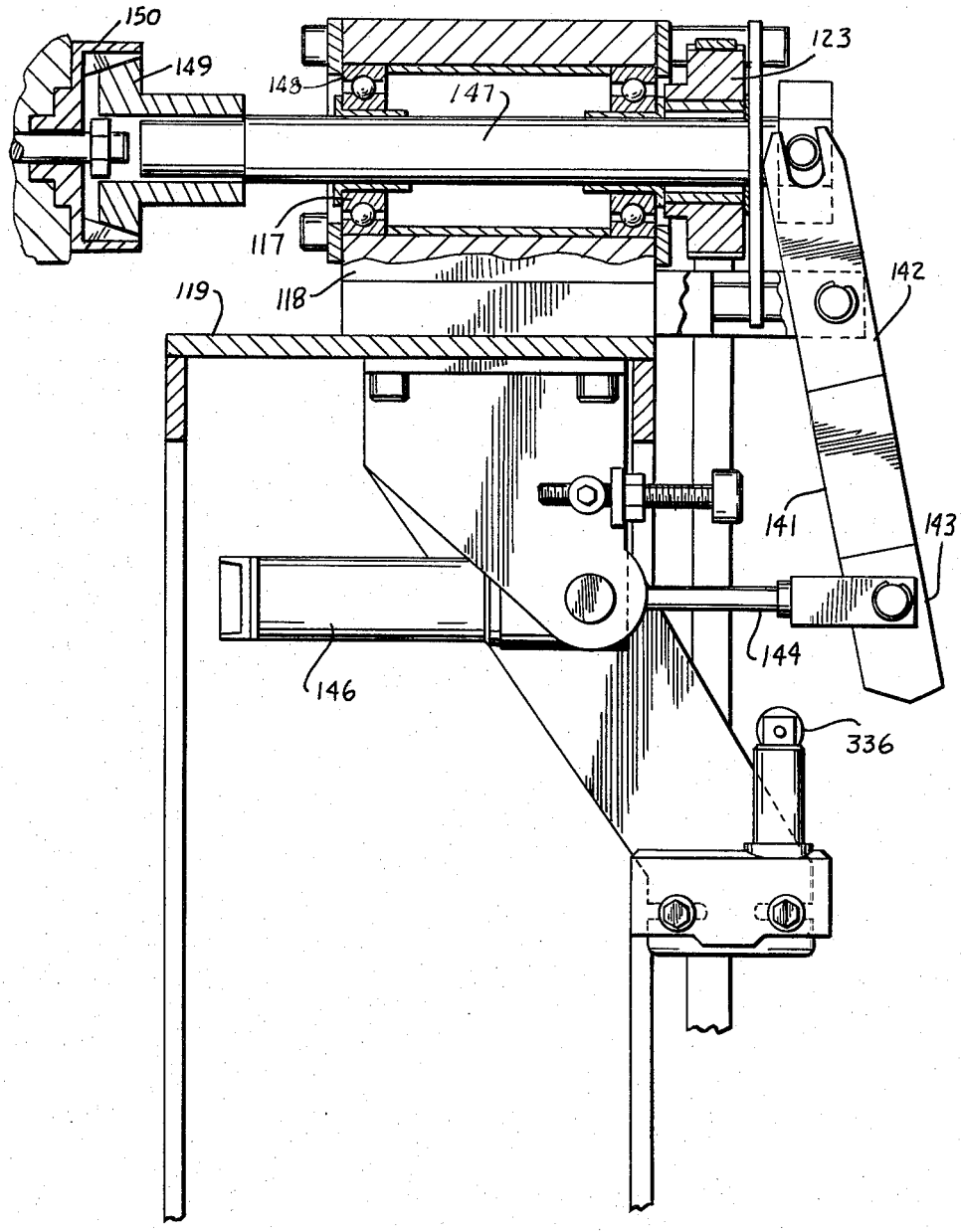
FIG. 8 is an elevational view, partially in section, which shows a clutch through which a spool assembly in one of the takeup positions is driven.

As can be seen in FIGS. 8–9, the clutch 112 and the actuator 130 may be replaced with another embodiment 145 which includes a rod 147 mounted in bearings 148—148 with a conical driving shoe 149 attached to a front end thereof. The shoe 149 is adapted to be received in driving engagement with a clutch plate 150 which is mounted on the turret arm 93 adjacent the hub 92 for receiving one end of the spindle 98. As should be apparent, the rod 147 extends through the sprocket 123 around which is passed the belt 124 of the hereinbefore-described embodiment which includes the toothed clutch 112.

Each turret 94 is mounted for rotation about a shaft 151 (see FIGS. 1 and 9) which is supported in the frame 90 that is mounted to the base 95. In the preferred embodiment, the turret 94 is designed to be moved rotatably in one direction by a chain 152 that is passed around a sprocket 153 that is attached to the shaft 151 and around a sprocket 154 that is driven through a drive train by a turret drive, gear motor 156. This arrangement provides the capability of precision indexing of the turret and, moreover, allows the turret to be selectively indexed in 90° or 180° increments.

Figure 10A:
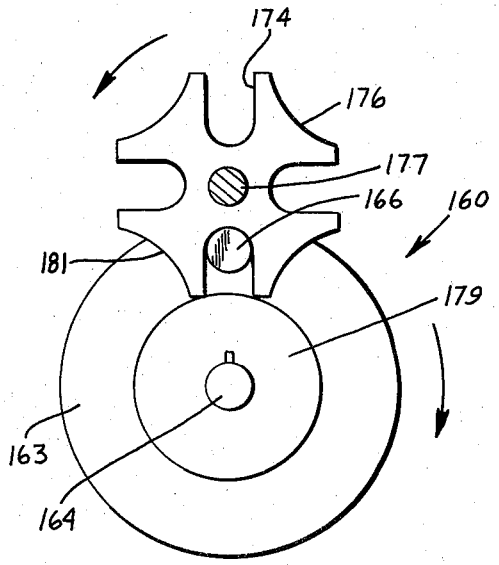
FIGS. 10A and 10B are enlarged views of a Geneva drive mechanism which is used to index the turrets of FIG. 1.
Figure 10B:
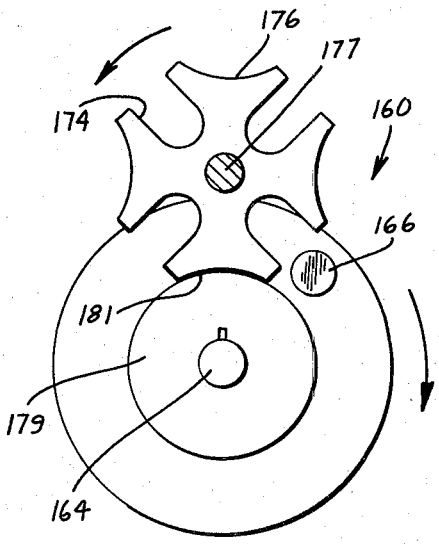

The movement of each turret 94 is accomplished with a commercially available Geneva drive 160 (see FIGS. 10A–10B) which is supported by two plates 161—161 upstanding from a pedestal 162 that is mounted on the base 95. The Geneva drive 160 includes an input wheel 163 having a stepped configuration mounted for rotation on a shaft 164 and having a drive pin 166 projecting laterally therefrom adjacent its periphery. The shaft 164 is supported in bearings 167—167 of the plates 161—161 and has a sprocket 168 mounted on one end thereof. A belt 169 is passed around the sprocket 168 and around a drive sprocket 171 that is mounted on a shaft 172 of the turret drive motor 156.

The drive pin 166 is designed to be seated successively within each of four equally spaced U-shaped drive slots 174—174 of an Geneva output wheel 176 which is mounted for rotation on a shaft 177 that is parallel to but spaced above the shaft 164. The output wheel 176 which is generally star-shaped is connected to its associated turret 94 so that when the input wheel 163 is turned by a drive motor 156, the pin 166 is caused to be moved in a circular path in one direction to enter the next successive U-shaped slot 174 to cause the output wheel to move in an opposite rotary direction. The U-shaped openings 174—174 correspond to 90° movements of the turret 94. Once the output wheel 176 has been turned through 90° or 180° as desired, the periphery of a small diameter portion 179 of the input wheel 163 engages a curved surface 181 between the drive slots to prevent rotation of the output wheel.

The turning of the output wheel 176 causes the turning of the sprocket 154 that is mounted on an end of the shaft 177 adjacent the outer plate 161. The sprocket 154 imparts motion to the chain 152 which is passed around the sprocket 154 and the other sprocket 153 that is mounted on an outer end of the shaft 151 which it will be remembered supports the turret arm 93. The turning of the sprocket 154 thereby causes the sprocket 153 and the turret 94 to be indexed through 90° or 180° as desired.

Once the turret 94 has been indexed to move an empty spool assembly 40 into one of the two side-by-side load positions, the empty spool usually is driven in a rotary clockwise direction as viewed in FIG. 9. The drive mode is automatic and is caused when a rear portion of the turret arm 93 is swung into a horizontal position to break a light beam of a photo-detector unit 191 adjacent the arm. This controls a circuit (not shown) to cause the air cylinder 146 to be controlled to extend its piston rod 144 and turn the lever 141 about its fulcrum. This permits the compression spring 138 to urge the pin end 132 into engagement with a side portion of the turret arm and thence into the opening to lock the arm in position. Further, the compression spring 125 which has a spring constant that is substantially less than that of the spring 138 urges the female portion 111 of the clutch 112 into engagement with the portion 113.

It should be observed that once a spool assembly 40 is in one of its load or takeup positions, it is rotated by the drive system that is connected to the motor 128. Until an operator controls the apparatus 30 by depressing an appropriate pushbutton swtich to index one of the turrets 94—94, or until one of the turrets is indexed automatically because a takeup length count has been achieved both spool assemblies 40—40 in the load positions are being rotated at the same speed albeit from independently supported spindles which extend toward each other.

The distribution of the lightguide fiber 31 from the drawing operation is made by a distributor 201 (see FIG. 9) which is mounted for reciprocal motion along rods 202—202. The distributor 201 is also mounted on a carriage 203 on a ball screw threaded rod 204 which extends across the two loading positions, is mounted in bearings 206—206 and is turned by its own drive motor 207. The turning of the rod 204 is controlled by a logic circuit such as that shown in FIG. 8 or by a system which is well known in the takeup art of strand material and which may be one shown for example in U.S. Pat. No. 3,408,013 issued Oct. 29, 1968 to L. P. Hauck, et al.

After the distribution of the lightguide fiber 31 has been made on one of the takeup spools 42—42, and cutover has been made to the adjacent spool assembly 40, a cutter 211 is operated to sever the lightguide fiber midway between the adjacent spool assemblies. The cutter 211 includes a housing 212 having an opening 213 which faces the centerline between the two spool assemblies 40—40. A cutting blade 214 is mounted slidably within the housing 212 so that it can be extended outwardly and between the adjacent spool assemblies 40—40 to sever the lightguide fiber. The cutting blade 214 is operatively connected to a rod 216 that extends parallel to a spool axis colinear with the axis of the turret shaft 151 and across the frame 91. A lever 217 is attached to the free end of the rod 216 outside one of the turrets 94—94 and is operated by a solenoid 219.

Figure 12A:
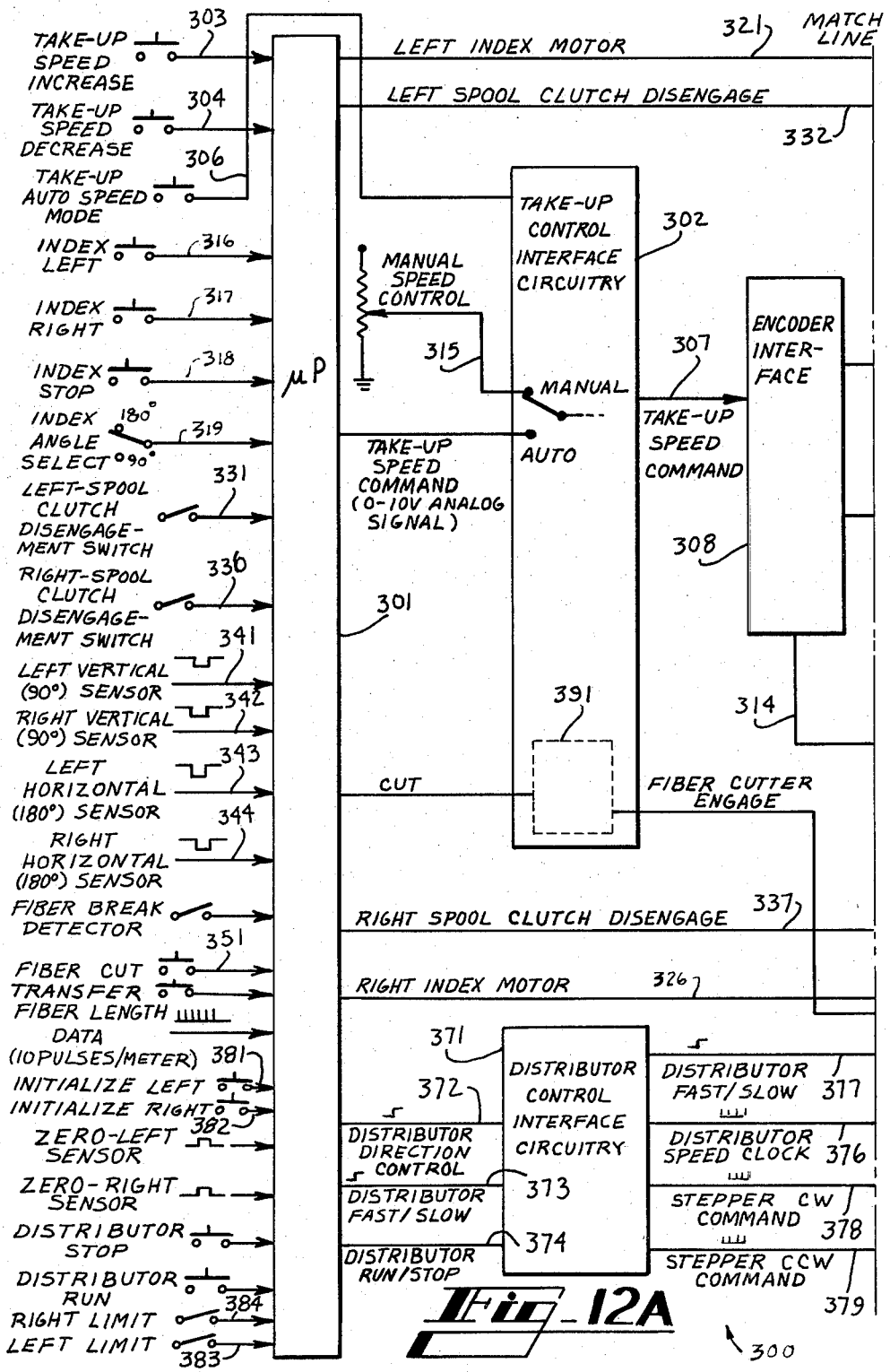
FIG. 12 is a schematic view of a system for controlling the operation of the takeup apparatus of FIG. 1 which is broken into FIGS. 12A and 12B.
Figure 12B:
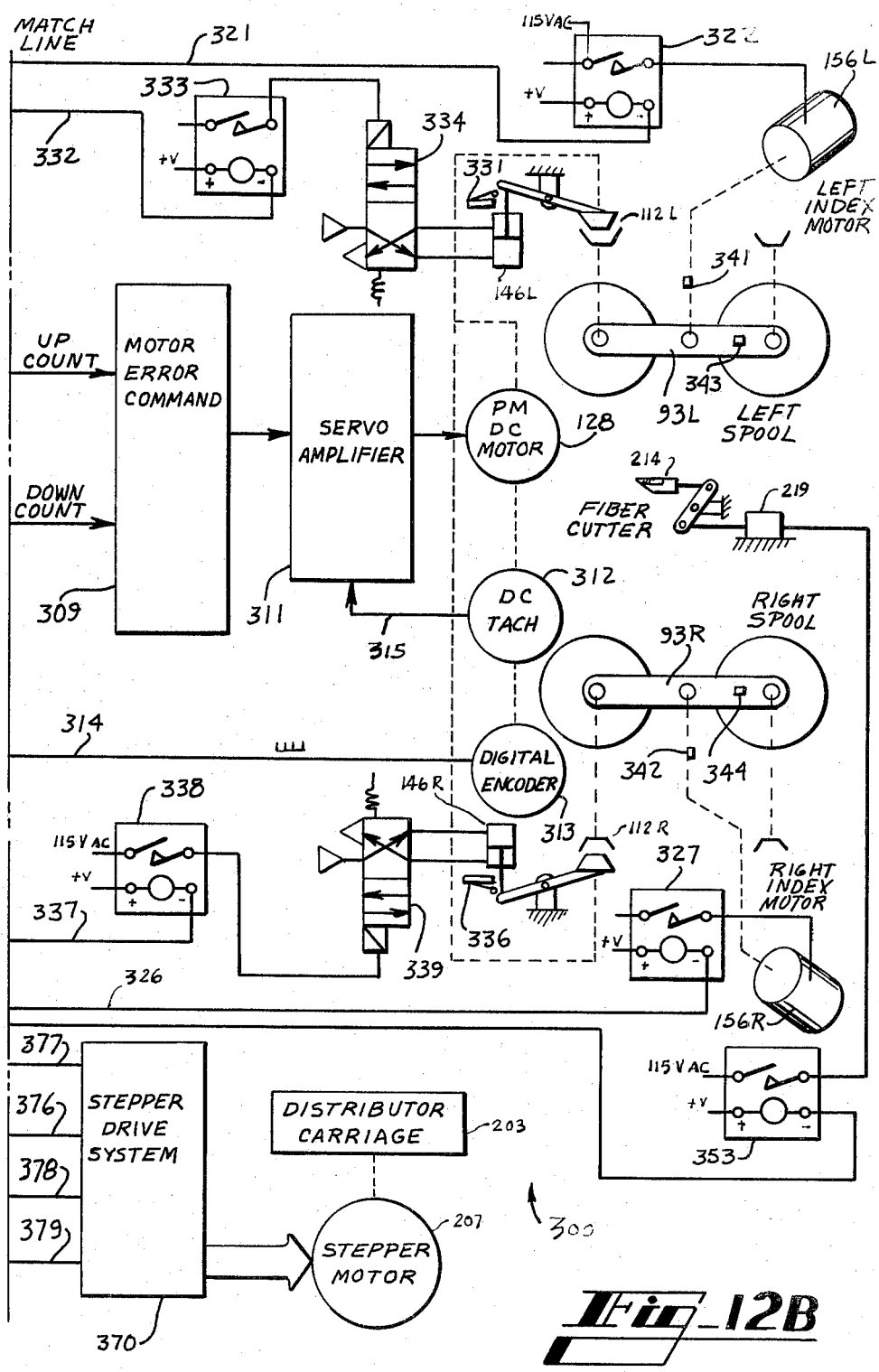

Viewing now FIG. 12, there is shown a system 300 in schematic form for controlling the operation of the apparatus 30. The system 300 is adapted to control the distribution of lightguide fiber 31 on the spools 42—42 in the takeup positions to effect cutover with severance of the fiber which extends between the spools and indexing of the turrets 94—94 to move full spools out of the takeup positions and empty spools thereinto.

As will be recalled, the distributor 201 is supported on rods 202—202 and is mounted for reciprocal motion along the lead screw 204 as turned by the stepper motor 207. The pitch of the lead screw 204 and the rotation of the shaft of the motor 207 are correlated so that the motor is caused to turn a predetermined number of degrees for each pulse received from a microprocessor 301 of the system 300. Moreover, a predetermined number of revolutions of the motor are designed to cause the distributor 201 to move a specific distance along the lead screw. In the preferred embodiment, the stepper motor 207 will rotate 1.8 degrees for each pulse which is fed to the stepper drive system 370. The frequency of the pulse signal which is fed to the stepper drive system 370 determines the speed of the stepper motor 207 and of the distributor 201.

The microprocessor 301 is informed as to the whereabouts of the carriage 202 by the passage of a pin 206 past one of two interruptors 302 and 303 which are mounted on the angle bracket 209 and which represent so-called zero-left (ZL) and zero-right (ZR) reference points of the left and the right takeup positions.

Each of the interruptors 302 and 303 is a commercially available device such as a photo detector which establishes a light beam in a vertical direction. When the pin 206 is passed between a source and a pickup of the device, the light beam is interrupted and a low voltage pulse is generated as an output.

The microprocessor 301 includes a distribution counter (not shown) which begins to count down from a preset number N when the pin 206 is passed through one of the interruptors 302 or 303. Also, the microprocessor includes intelligence to determine as a function of which interruptor is actuated on which side of the takeup the carriage is located. The microprocessor 301 further includes a length counter which counts pulses caused by the revolution of the draw system motor to count the length of the fiber 31 which is taken up on a spool 42.

In the system 300, the microprocessor 301 is connected to takeup control interface circuitry 302 for the spool drive motor 128 and is controlled in a manual mode by pushbutton switches 303 and 304 for motor speed increases and decreases, respectively and a pushbutton switch 306 for automatic mode operation. The automatic mode is tied into the catenary control system 32 of hereinbefore mentioned application Ser. No. 040,026 which is incorporated by reference hereinto. The takeup circuitry 302 inputs a takeup speed command 307 which is connected to an encoder interface circuit 308.

The microprocessor 301 reads the inputs of the nominal draw speed and catenary control and establishes takeup speed in order to provide a relatively low, controlled tension for the lightguide fiber 31. As can be seen in FIG. 12, the motor 128 is the main spool drive motor and, as will be remembered, it operates the jack shaft 122 to drive the spool assembly 40 in each of the two takeup positions.

The interface circuitry 302 receives an analog signal from the microprocessor 301 and generates a pulse train. Typically the circuitry 302 includes components such as one-shot multivibrators to convert negative going to positive going pulses, to increase the duration of pulses, or to change pulses from a low level to a high level. As for the operation of the motor 128, the circuitry 302 is provided with a zero to ten volt analog signal from the microprocessor 301 in response to an operator having depressed the automatic speed mode button 306 or an analog signal generated by a potentiometer 305 of the manual mode.

The encoder interface circuit 308 is capable of providing an up count or a down count input to a motor error command circuit 309 which inputs a servo amplifier 311 of the pulse modulated DC motor 128. A DC tachometer 312 of the motor 128 generates a DC voltage which is proportional to the speed of the motor as an input to the servo amplifier 311. The motor error command circuit 309 generates a pulse train which is proportional to the speed that is commanded by the microprocessor 301.

The servo amplifier 311, the DC motor 128 and the DC tachometer 312 comprise an inner, closed DC loop which nulls out the signal from the error circuit 309. The signal which is provided by the error circuit 309 is an analog DC signal which together with a signal along a line 315 from the DC tachometer 312 input a summing junction of the servo amplifier 311.

A digital encoder 313 is connected to the DC tachometer 312 and thence along a line 314 to the encoder interface circuit 308. The encoder interface circuit 308 compares its input from the takeup control interface circuitry 302 with the feedback pulse from the digital encoder 313. This is a pulse frequency comparison as opposed to the voltage comparison of a normal DC drive. Depending on whether the DC spool drive motor 128 is operating too fast or too slow, the encoder interface circuit goes high or low and sends pulses out on an up count or down count through the motor error command circuit 309 to the servo amplifier 311 in order to increase or decrease the speed of the spool drive motor.

In order to control the indexing of the turrets 94—94, the microprocessor includes input pushbutton switches 316 and 317 for index left and index right respectively and index stop 318 and an index angle selector 319. The microprocessor 301 also inputs along a line 321 to a left index motor 156 L through a solid state relay 322 which is operated by a 115 AC. The left index motor 156 L is connected in a manner described hereinbefore the left turret 94 L. In a similar manner the microprocessor 301 is connected along a line 326 to a right index motor solid state relay 327 which inputs the right index motor 156 R associated with the arm 95 of the right turret 94 R.

As will be recalled, the indexing of the turrets 94—94 is accomplished after the associated clutches 112—112 have been disengaged. The microprocessor 301 also includes a left spool clutch disengage control 331 which inputs along the line 332 to a solid state relay 333 having an input to a valve 334. The valve 334 controls the operation of the air cylinder 146 L which causes the left clutch 112 to be engaged or disengaged from the spool assembly 40 in the left takeup position. Also, the microprocessor 301 includes a right spool clutch disengage input 336 (see FIG. 8) which is connected along a line 337 to a solid state relay 338 that controls the operation of the right position air cylinder 146 R through a valve 339 to operate the clutch for the spool assembly in the right takeup position.

As can be seen, other inputs to the microprocessor 301 include left and right vertical or 90° sensors 341 and 342, respectively and left and right horizontal or 180° sensors 343 and 344. These sensors are actuated by movement of the spool assembly 40 into a position 90° or 180° from a takeup position.

Again referring to FIG. 12, the operation of the microprocessor 301 with respect to distribution of lightguide fiber 31 on the spools 42—42 will now be described. The movement of the distributor 201 is caused by a stepper motor 207 which is connected mechanically for movement along the Saginaw threaded rod and which comprises a portion of a stepper drive system 307 such as one available commercially from Computer Devices Inc. of California under the designation model number 334D9311. The stepper drive system 370 which provides 24 volt input to the motor 207 is controlled by the low voltage operating microprocessor 301 through distributor control interface circuitry 371.

The microprocessor 301 pulses the interface circuitry 371 through left-right direction control input 372 and through distributor fast-slow input 373 and distributor run-stop input 374. The fast-slow input 373 is accomplished through a high pulse count or a low pulse count which are programmed into the microprocessor 301.

Going now to the stepper drive system 370, it will be assumed that command is provided to it in terms of a high or a low to cause the motor 207 to increase or decrease its speed. It should be noted that relatively rapid speeds of the stepper motor 207 are used for initializing and transfer operations whereas the relatively slow speeds are used for normal distribution modes. The stepper drive system 370 sends out its own clock which is an evenly spaced pulse train 376 back to the interface circuitry 371 which inputs the stepper drive system in a fast or slow series 377. At the same time the microprocessor 301 commands the distributor control interface circuitry 371 as to the direction of the stepper motor. The distributor control interface circuitry gates the pulses out either to the clockwise or counterclockwise control lines 378 or 379.

The output 374 from the microprocessor 301 is an inhibitor which if in a run mode does not interfere with the operation of the stepper motor 207. On the other hand if the inhibitor 374 is in a stop mode, the pulse trains along the lines 378 and 379 are blocked which prevents the operation of the motor 207. The depression of the distributor run button 373 causes the distributor 201 to come off that stop which is manifested in the limit switch 383 and continue to distribute the fiber 31 on the spool 42 in that position.

To describe a cycle of operation, it will be assumed that an empty spool assembly 40 occupies each of the load positions and that the distributor is positioned in alignment with a collector spool 41 of the left one of the spools as viewed in FIG. 1. The operator threads the lightguide fiber from the drawing apparatus 31 through the catenary control system 32.

To begin a cycle of operation, an operator initializes the distributor 201 by pushing an initialize left button 381 or an initialize right button 382 whereupon the distributor is caused to move left until it engages an extreme-left limit switch 383 (or extreme-right limit switch 384) and stops. When the distributor 201 engages the left limit switch for example, an input to the microprocessor 301 informs the processor as to the location of the distributor.

The operator depresses a run button 385 and causes the distributor 201 to traverse the spool 42 in the left takeup position. A leading end of the lightguide fiber 31 coming out of the drawing apparatus 31 and the catenary control system 32 is attached to the hub of the spool 42 being traversed. Distributor 201 is caused to be moved from the inside of the left flange of the spool 42 in the left takeup position as viewed in FIG. 1 toward the inside of the right flange.

When the initial pulse is received by the microprocessor 301 from the ZL sensor 303 and assuming the distributor 201 is in the left mode as seen in FIG. 1, the distribution counter which has been preloaded with the number N is reset to N and begins to count down. The number N represents the number of pulses required to advance the distributor 201 from the Zero-Left position to the inside of the spool flange. Each count down is a function of each motor pulse received and after the distributor 201 has been moved a specific distance toward the right flange of a spool 42, the counter sends a signal to the microprocessor 301 to indicate that right flange count down has been achieved. As a result of having received that signal, the microprocessor 301 controls the interface circuitry to cause the motor 207 to turn in an opposite direction through one of the inputs 378 or 379 to the stepper drive system 370 to move the distributor 201 toward the left flange. At the same time, the distribution counter is reset to the same starting reference number N.

The distributor 201 is moved by the rotation of the lead screw 204 and after it passes the interruptor 303, a signal is sent to the microprocessor 301 to cause the counter to begin its count down toward the left flange of the spool in the left hand takeup position as viewed in FIG. 1.

The control system 300 of this invention can be adjusted in that the distribution count which is loaded into a register in the microprocessor 301 can be decremented selectively in order to taper the buildup of the lightguide fiber on the hub of the takeup spool in a predetermined manner. For example, on every other cycle in the preferred embodiment, the microprocessor 301 causes the reference number N which is preloaded into the counter to be decreased by 1. This causes the distributor 201 to have a slightly reduced length of travel from the reference point ZL or ZR toward each flange in each successive traverse and results in a tapered package of lightguide fiber on the spool in the takeup position. If the package were not tapered, the end convolutions of lightguide fiber which have been wound under relatively low tension would fall off. As should be apparent, the shape of the package can be adjusted by decreasing N at other than every other cycle of traverse or by decreasing N by a number greater than 1. The manner in which the count is decremented is also a function of the diameter of the lightguide fiber 31.

During distribution, the other counter in the microprocessor counts the length of lightguide fiber which is being taken up on a spool. A preset length count e.g. 2500 meters, which is called an achieve-length count is stored in the microprocessor. Each motor in the draw and takeup system is provided with an encoder to correlate the number of pulses out of a drive motor to the amount of fiber that is caused to be moved by that motor. The microprocessor 301 is referred to a draw motor (not shown) so that every 5000 pulses represents one meter. The 5000 is divided by 500 and the quotient is fed to the microprocessor 301 so that 10 counts represent the takeup of one meter.

After 2500 meters have been taken up on the spool assembly in the left takeup position, the microprocessor 301 automatically initiates a transfer to the spool in the right takeup position. However, in the start up of the apparatus 30, after the operator is satisfied that conditions exist for takeup, the operator depresses the transfer pushbutton switch which causes cutover from the spool in the left position to the empty spool in the right takeup position.

At cutover, any one of four conditions could exist. The distributor 201 could be (1) left of the ZL position and traveling to the left, (2) left of ZL and traveling to the right, (3) right of the ZL position and traveling to the right or (4) right of the ZL position and traveling to the left. Of course, eight conditions could exist since the distributor 201 could be moving about the ZL or the ZR position, but since in the initial interruption, the microprocessor 301 can discern on which side of the takeup the distributor is located, only four conditions must be considered.

Should the distributor 201 be left of ZL when the cutover signal, a transfer, length-achieved pulse, is received, and traveling left with the distribution counter counting down, and the stepper motor 207 in its normal speed mode, the motor is caused to be turned in an opposite direction through one of the stepper drive system inputs 378 or 379 and the carriage caused to be moved to the right at an accelerated velocity by a high on the pulse through inputs 377 to the stepper drive system. The counter is loaded with a number which represents the distance from ZL to the collector spool of the spool assembly 40 in the right takeup position and it begins to count down until the distributor is aligned with the right collector spool whereupon the operation of the motor 207 is discontinued. A relatively short length of fiber 31 as manifested by a few convolutions are collected on the collector spool after which the distribution counter that is also loaded with a number that represents the distance from the center of the collector spool to the inside flange of the takeup spool causes the distributor 201 to be moved at the rapid speed mode to that position this causes the whiskers adjacent the centerline of the frame to cause the fiber 31 to be thrown into the groove of the empty spool until several convolutions have been deposited therein. A few turns of fiber are taken up on the spool hub whereafter distribution begins on the right hand spool using ZR as the reference point.

Turning now to condition (2), the distributor 201 is left of the ZL point and traveling at its distribution mode of speed to the right. The transfer pulse is received and the motor is caused to be turned at its rapid speed to move the distributor rapidly to the collector spool of the right spool.

On the other hand, if the distributor 201 is to the right of ZL and traveling rightwardly at cutover time, there is no indication of how close it is to the ZL position. So at cutover, it is caused to be reversed and be moved leftwardly at high speed to pick up the ZL position whereupon the motor reassumes a low distribution speed and the distribution is continued for some small count after which the motor is again reversed, the counter loaded, and the high speed mode is assumed. The pin 206 picks up the ZL position and the distributor 201 is moved at the high speed mode to the right hand collector spool.

Going now to the fourth and final condition, should the distributor be to the right of ZL and moving leftwardly at cutover, it is moved rapidly to ZL and slightly past it to the left at low speed, whereafter the motor is reversed, the counter loaded and the distributor moved rapidly to the right to the collector spool in the right hand takeup position.

After the distribution of fiber 31 begins on the spool in the right hand position, the microprocessor 301 causes the cutter blade 214 to be moved by the solenoid 219 to sever the fiber between the adjacent collector spools. Although the cutter may be operated manually, it may easily be arranged for automatic operation as controlled by the microprocessor 301 which outputs a command signal through cutter control circuit 391. The cutter control circuit causes a stretching of the pulse to a length of time which is necessary to hold the cutter engaged to positively sever the lightguide fiber. This time is usually on the order of magnitude of one to two seconds. At that time, a solid state relay 219 is caused to operate which in turn operates the solenoid 353 through linkage which causes the blade 214 to sever the fiber 31. After the pulse times out, the solenoid 219 drops out and the cutter is spring-returned to a position within its housing.

Subsequent to severing of the fiber 31, the left turret 94 L is indexed through an angle of 90° or 180°. Depending on whether the full spool is to be removed or whether the full and empty spool assemblies 40—40 on the turret 94 L are to exchanged. In order to index the spool assembly 40 in the left hand takeup position, the index left pushbutton 316 is depressed and the microprocessor 301 is caused to check to determine that the distributor 201 is not in its left hand traverse mode. The operation of the pushbutton 316 provides an input along a line 332 to pull the line low which causes the solenoid to be closed by the solid state relay 333. This causes the solenoid valve 334 to open which puts air on one side of the piston of the air cylinder 146 in order to disengage the clutch 112. After the clutch 112 is disengaged, the switch 331 is closed. The closing of the switch 331 informs the microprocessor 301 that the clutch 112 is disengaged whereupon the microprocessor pulls line 321 low which turns on the solid state relay 322 to supply 115 volts to the left hand side index motor 156 L. The left hand index motor 156 L rotates and turns the turret 94 L about its axis. The drive motor is operated to turn the Geneva input wheel 163 to turn the output wheel which rotates the sprocket and belt to rotate the turret 94 L.

When the full spool assembly 40 is moved out of the left takeup position, it is moved 90° and if a 90° rotation had been selected by pushbutton switch 309, the operation of the left hand index motor 156 L is discontinued. At that time, the arm 93 actuates the vertical sensor 341 input to the microprocessor 301 which causes the line 332 to go high and operate the solid state relay 333 which causes the air cylinder to reengage the clutch. On the other hand, if 180° rotation had been selected by the switch 309, the line 332 will still go low as the full spool is moved into the 90° position and the clutch plate 113 is moved inwardly. However, since the mating portion of the clutch is not aligned therewith, reengagement of the portion 113 is ineffective at this time. Then when the turret 94 continues its rotation to the 180° position, the clutch is disengaged again and reengaged when the full spool is moved into the rear 180° position and the arm 93 actuates the horizontal sensor 343. It will be recalled that the full 180° index is only used when it is necessary to remove a full spool from the turret. Should it be necessary for purposes of capacity to remove the full spool, then the turret would be indexed to the 90° position.

This sequence of operations is continued until all four of the spool assemblies 40—40 have been filled with the fiber 31. Of course, if the four spools 42—42 are not sufficient to takeup the total yield of a preform, one or more of the turrets can be indexed 90°. As one of the spools is filled, a full spool is removed and replaced with an empty spool to accommodate the additional fiber.

It is to be understood that the above-described arrangements are simply illustrative of the invention. Other arrangements may be devised by those skilled in the art which will embody the principles of the invention and fall within the spirit and scope thereof.

What is claimed is:

1. A method of taking up lightguide fiber said method comprising the steps of:

supporting each of a first and second plurality of spools for rotation about an axis, said axes of rotation of said spools of each plurality being parallel;

mounting each plurality of spools for revolution about an axis which is parallel to the axes of rotation of spools of said plurality, said axes of rotation of said spools of each plurality being spaced equal distances from the axis of revolution of said each plurality;

holding one of said spools of said first plurality in a first takeup position in coaxial alignment with one of said spools of said second plurality in a second takeup position;

rotating said spools in said takeup positions;

taking up a length of the lightguide fiber adjacent one flange of the one spool of said first plurality in said first takeup position; then distributing a predetermined length of the fiber in a plurality of convolutions across the spool in the first takeup position; then causing a length of the fiber to be taken up adjacent to one flange of the spool in the second takeup position, said one flange of the spool in the second takeup position being adjacent the one flange of the one spool in the first takeup position; then distributing a predetermined length of the fiber in a plurality of convolutions across the spool in the second takeup position;

severing the lightguide fiber which extends between the spools in the first and the second takeup positions; and causing revolution of the first plurality of spools to move said one spool on which has been distributed said predetermined length of fiber in a plurality of convolutions out of the first takeup position.

2. The method of claim 1, wherein subsequent to the step of causing revolution of the one plurality of spools, the full spool which has been moved out of the first takeup position is removed from the plurality of spools with which it is associated and replaced with an empty spool.

3. The method of claim 1, wherein the two spools in the two takeup positions are turned rotatably simultaneously, the rotation of a full spool being discontinued prior to the revolution of the plurality of spools with which it is associated.

4. The method of claim 3, wherein the revolution of the plurality of spools which includes the full spool causes an empty spool to be moved into the takeup position out of which the full spool was moved.

5. The method of claim 4, wherein subsequent to the revolution of a plurality of spools to position an empty spool in one of the takeup positions, said empty spool is caused to begin rotation with the already rotating spool in the other takeup position.

6. The method of claim 1, wherein said pluralities of spools are mounted to cause the axes of revolution to be colinear.

7. The method of claim 1, wherein said distribution of the lightguide fiber on each spool about a reference point on said each spool is decremented in a predetermined manner to provide a takeup package of lightguide fiber having a controlled slope from the reference point of each flange.

8. An apparatus for taking up lightguide fiber which is drawn from a preform, said apparatus icluding:

means for supporting each of a first and a second plurality of spools for rotation about an axis of a surface of said each spool on which lightguide fiber is capable of being taken up;

means for mounting each plurality of spools of revolution about an axis which is parallel to the axis of rotation of each spool of each plurality, with said axis of rotation of each of said spools being an equal distance from the axes of revolution;

means for holding one of said spools of said first plurality in a first takeup position in coaxial alignment with one of said spools of said second plurality of spools in a second takeup position;

means rendered effective by a spool being in one of the takeup positions for rotating said spool in said takeup position;

means mounted for reciprocal movement along a path of travel which is parallel to and spaced from the colinear axes of rotation of the spools in the first and the second takeup positions for distributing lightguide fiber on one of said spools in one of said takeup positions;

means for causing a relatively short length of lightguide fiber to be taken up on a collector spool which is attached to one of the spools in one of the takeup positions adjacent a centerline of the apparatus and for then distributing a plurality of convolutions of lightguide fiber on the spool in the one position;

means responsive to the takeup of a predetermined length of fiber on the spool in the one position for causing a relatively short length of lightguide fiber to be taken up on the collector spool which is connected to the spool in the other takeup position and subsequently for causing a plurality of convolutions to be distributed on the spool in the other position, said collector spools being adjacent each other;

means for separating the fiber which has been taken up on the spool in the one takeup position from the relatively short length of the spool in the other takeup position to provide an accessible beginning end portion on the other spool; and means responsive to the separation of the fiber for revolving said first plurality of spools to move the full spool out of the one takeup position.

9. The apparatus of claim 8, which also includes means responsive to the distribution of lightguide fiber on each spool about a reference point on the spool for controlling the distributing means to decrement in a predetermined manner the distribution of convolutions of fiber across the spool to cause the package of fiber to have a controlled slope from the reference point to each flange.

10. The apparatus of clam 8, wherein the means for moving of the full spool out of the one takeup position causes an empty spool to be moved into the one takeup position; said apparatus also including means responsive to the transfer of the fiber to the spool in the other position for discontinuing rotation of the full spool in the one takeup position.

11. The apparatus of claim 9, which also includes means responsive to the movement of the full spool to a predetermined position for causing an empty spool which is moved into the one takeup position to be driven rotatably.

12. The apparatus of claim 10, wherein said supporting means includes a pair of turrets having a spool mounted rotatably on each end thereof.

13. The apparatus of claim 12, which also includes means rendered effective by the movement of one end of each turret into the takeup position for locking the turret in a position such that an empty spool is in the one takeup has its axis colinear with that of the spool in the other position.

14. The apparatus of claim 13, wherein said means for rotating each of said spools in each of said takeup positions includes a clutch.

15. The apparatus of claim 14, which also includes means responsive to the separation of the fiber between spools in the takeup position for disengaging the clutch which drives the spool in the takeup position.

16. The apparatus of claim 15, wherein said clutch comprises one portion which is biased by a first spring into driving engagement with a portion of the clutch on said turret, said locking means includes a pin, said turret includes an opening which is aligned with said pin when said spool is aligned with the other spool, and said pin being biased into engagement with said opening by a second spring.

17. The apparatus of claim 16, wherein the spring constant of said first spring is substantially less than the spring constant of said second spring.

18. An apparatus for taking up lightguide fiber which is drawn from a preform, said apparatus including:

a first and a second plurality of spools;

means for supporting each of the first and the second plurality of spools for rotation about an axis of a surface of said each spool on which lightguide fiber is capable of being taken up;

means for mounting each plurality of spools for revolution about an axis which is parallel to the axis of rotation of each spool of each plurality, with said axis of rotation of each of said spools being an equal distance from the axes of revolution;

means for holding one of said spools of said first plurality in a first takeup position in coaxial alignment with one of said spools of said second plurality of spools in a second takeup position;

means rendered effective by a spool being in one of the takeup positions for rotating said spool in said takeup position;

means mounted for reciprocal movement along a path of travel which is parallel to and spaced from the colinear axes of rotation of the spools in the first and the second takeup positions for distributing lightguide fiber on one of said spools in one of said takeup positions;

means for causing a relatively short length of lightguide fiber to be taken up on a collector spool which is attached to one of the spools in one of the takeup positions adjacent a centerline of the apparatus and for then distributing a plurality of convolutions of lightguide fiber on the spool in the one position;

means responsive to the takeup of a predetermined length of fiber on the spool in the one position for causing a relatively short length of lightguide fiber to be taken up on the collector spool which is connected to the spool in the other takeup position and subsequently for causing a plurality of convolutions to be distributed on the spool in the other position, said collector spools being adjacent each other;

means for separating the fiber which has been taken up on the spool in the one takeup position from the relatively short length on the spool in the other takeup position to provide an accessible beginning end portion on the other spool; and means responsive to the separation of the fiber for revolving said first plurality of spools to move the full spool out of the one takeup position.

19. The apparatus of claim 18, wherein each said collector spool is capable of being disassembled from its associated takeup spool.

20. The apparatus of claim 18, wherein each said collector spool includes a peripheral groove for receiving a relatively few convolutions of fiber.

21. The spool of claim 20, wherein each of the flanges of said collector spool includes a plurality of flexible, whiskers projecting outwardly from each flange of said collector spool and spaced about the periphery thereof.

22. The spool of claim 20, wherein the peripheral groove has a first lead in portion in which opposing walls are sloped at a predetermined angle therebetween, and an inner portion communicating with said lead-in portion, said inner portion having opposing walls with the angle therebetween being substantially less than the angle between the walls of the lead-in portions.

23. The spool of claim 22, which also includes a resilient whisker projecting inwardly into said groove from each of said opposing walls, said fiber being caused to deflect said whiskers and be moved into said inner portion of said groove.

* * * * *

UNITED STATES PATENT AND TRADEMARK OFFICE

CERTIFICATE OF CORRECTION

PATENT NO. : 4,291,841

DATED : September 29, 1981

INVENTOR(S) : Philip W. Dalrymple, Michael J. Hyle, Daryl L. Myers, and James G. Wright, Jr.

It is certified that error appears in the above—identified patent and that said Letters Patent is hereby corrected as shown below:

Column 16, line 37 change "of" to ---for---

Column 17, line 5 change "of" to ---on---

Column 17, line 19 change "clam" to ---claim---.

Signed and Sealed this

*Fifteenth* Day of *December 1981*

[SEAL]

*Attest:*

GERALD J. MOSSINGHOFF

*Attesting Officer*

*Commissioner of Patents and Trademarks*